United States Patent [19]

Niezgoda et al.

[11] 4,333,377

[45] Jun. 8, 1982

[54] TONE GENERATION SYSTEM FOR ELECTRONIC MUSICAL INSTRUMENT

[75] Inventors: Thomas A. Niezgoda, DeKalb; Carl P. Oppenheimer, Sycamore, both of Ill.

[73] Assignee: Acoustic Standards, Orange, Calif.

[21] Appl. No.: 240,183

[22] Filed: Mar. 3, 1981

Related U.S. Application Data

[63] Continuation of Ser. No. 67,425, Aug. 17, 1979, abandoned.

[51] Int. Cl.[3] ..... G10H 1/057; G10H 1/46

[52] U.S. Cl. ..... 84/1.27; 84/1.1; 84/1.22; 84/1.26

[58] Field of Search ..... 84/1.01, 1.03, 1.1, 84/1.13, 1.22, 1.26, 1.27

[56] References Cited

U.S. PATENT DOCUMENTS

| | | | |
|---|---|---|---|
| 3,588,310 | 6/1971 | Gschwandtner | 84/1.13 |
| 3,882,751 | 5/1975 | Tomisawa et al. | 84/1.01 |
| 3,903,775 | 9/1975 | Kondo et al. | 84/1.01 |
| 3,935,783 | 2/1976 | Machanian et al. | 84/1.1 X |
| 4,018,125 | 4/1977 | Nishimoto | 84/1.26 X |
| 4,036,096 | 7/1977 | Tomisawa et al. | 84/1.01 |
| 4,067,253 | 1/1978 | Wheelwright et al. | 84/1.1 |
| 4,135,424 | 1/1979 | Okamoto | 84/1.13 |
| 4,154,133 | 5/1979 | Kitagawa | 84/1.26 |
| 4,178,822 | 12/1979 | Alonso | 84/1.01 |

*Primary Examiner*—Stanley J. Witkowski

*Attorney, Agent, or Firm*—Gausewitz, Carr, Rothenberg & Edwards

[57] ABSTRACT

A tone generation system is intended for use with an electronic musical instrument of the type wherein an audible tone is generated electronically in response to actuation of the instrument by a player. The invention generates digital signals capable of defining either the waveshape or the envelope or characteristic of a tone for each tone initiated by such player actuation the latter envelope being varied in accordance with the intensity of the player actuation initiating that tone. In the latter case, digital electronic circuits are utilized for developing a digital scaling signal S corresponding to the intensity of actuation of the instrument by the player, and a digital envelope signal which represents slopes and Y intercepts of portions of a composite waveform, viewed in an orthogonal coordinate system. These digital circuits arithmetically manipulate these scaling signals and envelope signals to give a composite output signal defining the envelope.

9 Claims, 14 Drawing Figures

MUXA
MUXB
MUXC
1X0
2X0
8X0
MUX
110
X0
1X4
2X4
8X4
MUX
118
X4
1X1
2X1
8X1
MUX
112
X1
1X5
2X5
8X5
MUX
120
X5
1X2
2X2
8X2
MUX
114
X2
1X6
2X6
8X6
MUX
122
X6
1X3
2X3
8X3
MUX
116
X3
1X7
2X7
8X7
MUX
124
X7

MUXA
MUXB
MUXC
1S0
2S0
8S0
MUX
130
S'0
S'0
S'1
S'2
S'3
S'4
ROM
142
S0
S1
S2
S3
S4
144
1S1
2S1
8S1
MUX
132
S'1
1S3
2S3
8S3
MUX
136
S'3
1S2
2S2
8S2
MUX
134
1-74
S'2
8-74
MUX
140
Eh
1S4
8S4
MUX
138
S'4

A=B
340
MUXCLK
MUXCLK/2
334
332
330
MUXB
MUXC
MUXA
DECODER
168a
320
FF
B+
77-1
COUNTER
170a
92a-1
328
FF
77-8
COUNTER
184a
92a-8

MUXCLK/2
MUX A
MUX B
MUX C
88a
494
496
498
500
INTER-POLATE 502
492
482
COUNTER
480
B+
FFQ
462
FAST
NORM
NORMX32
FASTX32
MUXCLK
STROBE
B+
FFQ̄
460
COUNTER
464
FFQ
468
COUNTER
466
FFQ
470
B+
487
484
D Q
FF
CLK
486
490
488

TONE GENERATION SYSTEM FOR ELECTRONIC MUSICAL INSTRUMENT

This application is a continuation of application Ser. No. 67,425, filed Aug. 17, 1979 and now abandoned.

BACKGROUND OF THE INVENTION

This invention relates generally to tone generation in electronic musical instruments and more particularly to the generation of a suitable tonal waveform and/or envelope for generated tones in such an instrument. This disclosure will address the problems of envelope production specifically, although the invention is applicable to generation of both waveforms and envelopes.

A major area of endeavor in the electronic musical instrument arts has been to develop electronic systems for simulating the overall tonal quality and response characteristics of conventional musical instruments. Because of the time-varying and complex waveforms and envelope characteristics of the tones associated with many musical instruments, it has heretofore been difficult or impossible, either from a technical or financial standpoint, to generate electronically the requisite signals to simulate such waveforms and envelope characteristics to any degree of accuracy.

For example, a conventional piano produces a tone having an envelope characteristic which very rapidly reaches a peak or maximum intensity and thereafter decays at a predetermined or inherent rate, either naturally after an extended time period or upon release of a key which causes a damper to engage and stop the vibrating piano wire. Similarly, with other instruments, there is generally an attack and decay envelope characteristic associated with the instrument, which is often relatively difficult to accurately reproduce electronically.

Notwithstanding the foregoing difficulties, many attempts to electronically generate such tonal envelopes have been made with varying degrees of success. The prevalent approach of prior art devices has been to employ various forms of capacitor charge and discharge circuits. The generally exponential discharge characteristics of capacitors simulate a typical percussion voice decay characteristic (e.g., of a piano) closely enough so as not to be audibly objectionable. This characteristic may not be suitable, however, for simulating other instruments, e.g., strings or wind instruments. This then leaves the problem of providing some means responsive to the intensity of player actuation (e.g., in a keyboard instrument, the intensity with which the player depresses a key) to produce a suitable signal corresponding to the peak or maximum level of the envelope, to insure a signal of proper over-all amplitude level or "scale". In the prior art this has commonly been accomplished by some sort of electromechanical transducer responsive to each tone initiating actuation of the player. In the case of a keyboard instrument this requires such a transducer associated with each key of the keyboard. One such electromechanical transducer is shown, for example, in Gschwandtner, U.S. Pat. No. 3,588,310. Other arrangements of the prior art have made use of multiple capacitor charging and discharging circuits in combination with suitable gating elements to simulate percussion (e.g. piano) envelope characteristics. Such a system is shown, for example, in Machanian et al. U.S. Pat. No. 3,935,783.

While the systems and devices of the above-mentioned prior art patents have proven useful for their stated purposes, the present invention improves upon these systems by providing both a high degree of accuracy in reproduction of envelope waveshapes of conventional musical instruments and ability to generate a plurality of different such envelope waveshapes.

With the advent of relatively inexpensive and flexible digital electronic circuits and particularly the availability of low cost large scale integrated circuits and the technique for their design and manufacture, other approaches to this problem have become feasible. For example, Wheelwright et al, U.S. Pat. No. 4,067,253, shows one form of tone generating system, specifically designed for simulating an instrument of the percussion type (e.g. a piano). This patent shows a system which makes use of digital processing techniques and digital electronic circuits to a certain extent. It is the intent of the present invention to utilize digital processing techniques and digital electronic circuits to an even greater extent and in doing so, to present a significant improvement over the prior art.

The present invention involves the use of digital processing techniques and digital electronic circuit design, as mentioned, to provide an envelope generation system that may advantageously be realized as a single large scale integrated circuit chip. This integrated circuit chip accommodates a plurality of individual and independent tone signal initiation means as imputs. For example, in the case of a keyboard instrument, a plurality of keys thereof are accommodated. The invention includes an independent envelope generator for each tone initiating means (e.g. key) responsive to that tone initiating means and in particular to the force (velocity) with which the tone initiating means is struck. The envelope generators of the invention are further individually controllable as to the exact relation of their output signals (envelope waveform) to the force or velocity with which the key or other tone initiating means is initiated, and also as to the shape of the envelope waveform generated thereby. Advantageously, therefore, the invention is unexpectedly flexible, being able to generate virtually any desired envelope shape.

OBJECTS AND SUMMARY OF THE INVENTION

Accordingly, it is a general object of the present invention to provide a new and improved envelope generation system for an electronic musical instrument.

A more specific object is to provide an envelope generation system that may readily be implemented as a large scale integrated circuit.

A further object of the invention is to provide an envelope generation system of the foregoing type which comprises plural independent envelope generators, each being controllable as to the relationship of its output signal to the force of velocity of tone initiation or actuation as well as to the shape of the envelope generated thereby.

Yet another object is to provide an envelope generation system of the foregoing type which is further sufficiently flexible to permit the generation of virtually any desired envelope shape.

A still further object is to provide an envelope generation system in accordance with the foregoing objects which is relatively simple and inexpensive in its manufacture yet highly reliable in operation.

In accordance with the foregoing objects, a waveshape generating system for an electronic musical instrument of the type wherein an audible tone is generated electronically in response to a tone-initiating actuation of the system by a player of the instrument comprises at least one waveshape generator having an output signal corresponding to a desired waveshape, said generator comprising: circuit means responsive to a tone-initiating player actuation of the instrument for producing control signals, waveform control circuit means responsive to said control signals for generating a series of predetermined digital waveshape segment defining signals and arithmetic circuit means for performing predetermined arithmetic functions utilizing said digital waveshape segment defining signals and said control signals to produce thereform a series of digital signals defining said desired waveshape.

BRIEF DESCRIPTION OF THE DRAWINGS

Other objects, advantages and features of the present invention will become more readily appreciated upon consideration of the following detailed description of the illustrated embodiment, taken in conjunction with the accompanying figures of drawings, wherein.

DETAILED DESCRIPTION OF THE PREFERRED EMBODIMENT

While it is not desired to so limit the invention, the specific embodiments illustrated for purposes of description are intended primarily for use in generating envelope waveforms in a keyboard type of electronic musical instrument.

Figure 1:
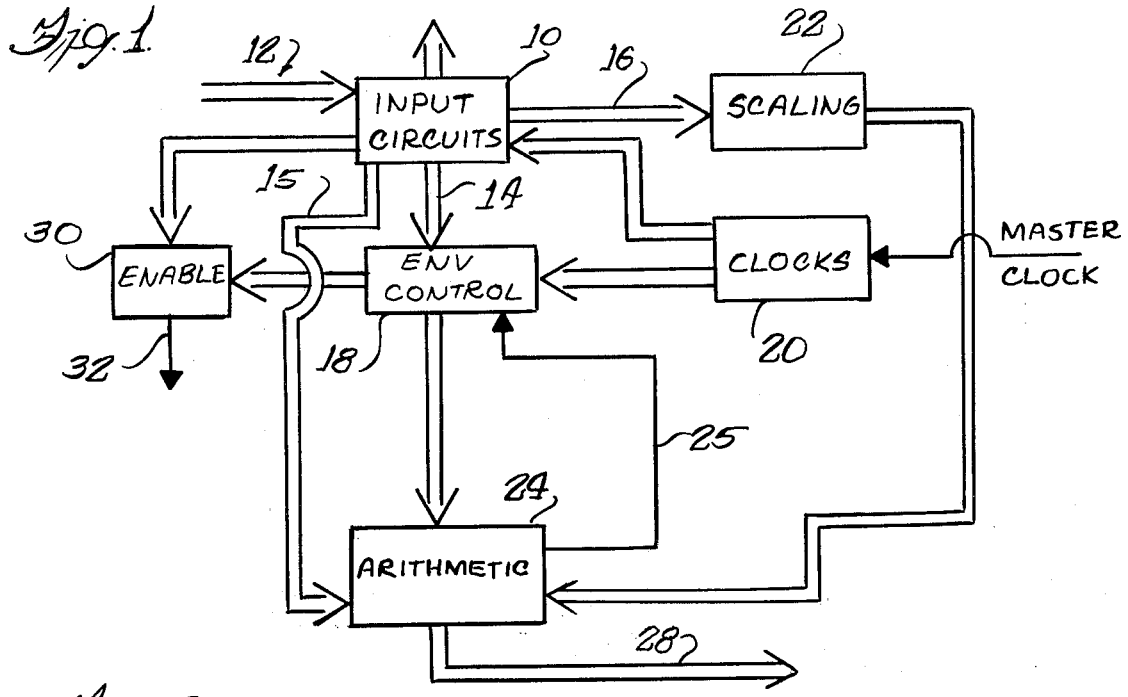
FIG. 1 is a functional block schematic diagram of the electronic circuits of the invention.

Reference is directed initially to FIG. 1, wherein a block schematic diagram illustrates a novel envelope generation system according to the present invention. Advantageously, this novel envelope generation system is suitable for incorporation in a large scale integrated circuit (LSI) chip, utilizing conventional LSI fabrication technology.

Turning now more particularly to FIG. 1, the novel envelope generation system of the invention includes input circuits 10 which receive suitable inputs designated generally 12 from the electronic musical instrument. Generally speaking, these inputs 12 carry suitable signals indicative of player actuation of the instrument for initiation of a tone. The input circuits 10 respond by producing a series of envelope control signals over output lines 14, by producing a series of envelope count signals over output lines 15 and by producing a scaling control signal over output lines 16. Advantageously, the scaling control signal produced by the input circuits 10 bears a predetermined relation to the intensity of player actuation of the instrument in initiating a tone.

The series of envelope control signals on the lines 14 are delivered to envelope control circuits 18 which also receive suitable clock signals from clocks 20. These envelope control circuits 18 respond, generating a series of digital signals which generally define segments or sections of preselected envelope waveforms. The scaling signals on the lines 16 feed a scaling circuit 22 which produces, in response thereto, a digital scaling signal representative of the relative amplitude of the initiated tone, and hence the relative level or amplitude of its tonal envelope, with respect to the intensity of the player actuation of the instrument. The envelope control circuits 18, the scaling circuit 22 and the output lines 15 of the input circuits 10 feed arithmetic circuits 24 which arithmetically operate upon the envelope segment signals, upon the scaling signals and upon the series of envelope counter signals on lines 15 from the input circuits 10 to produce a series or sequence of digital envelope signals comprising the desired envelope waveshape, in digital representation.

Summarizing, the arithmetic circuits 24 and the scaling circuits 22 operate to produce a series or sequence of digital envelope signals on output lines 28 as a sequence or series of composite digital signals which define a scaled envelope waveform. The arithmetic circuit 24 also generates a suitable feedback signal for envelope control circuit 18, fed thereto on a line 25.

A suitable master clock signal drives the clock circuits 20. The input circuits 10 also generate enable signals and feed these enable signals to an enable circuit 30, which produces an enable control signal output on a line 32.

Figure 2:
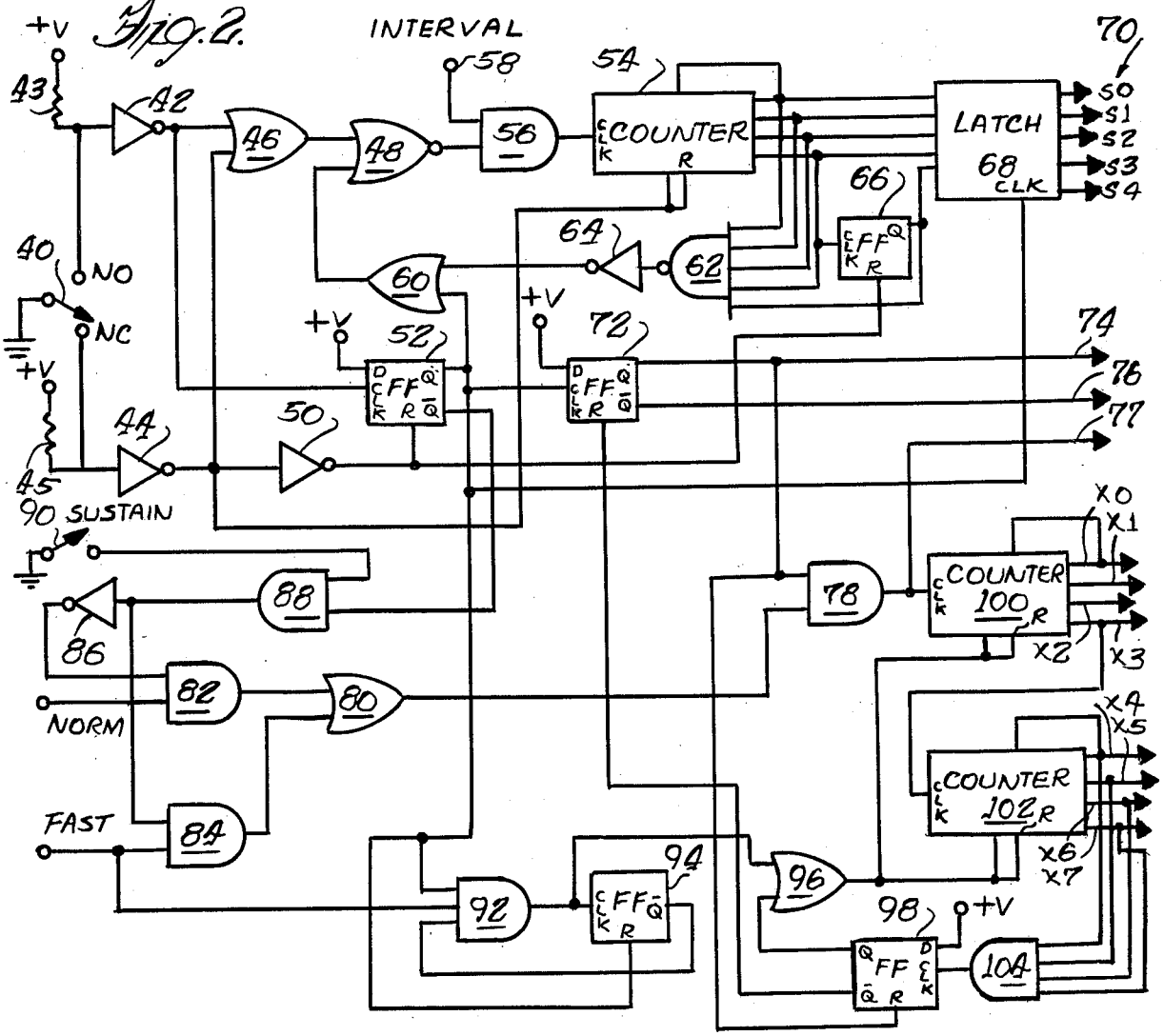
FIGS. 2, 3, 4, 5, 6, 7, 8 and 9 are schematic circuit diagrams illustrating one embodiment of the invention.

Referring now to FIG. 2, the input circuits 10 are illustrated in detail. It should be recognized that in FIG. 2 as well as in FIG. 3 through FIG. 9, inclusive, discrete logic components are illustrated for purposes of explaining the operation of the invention. The invention is not limited thereto, however, it being contemplated, for example, that the circuits of the invention may be realized as a single LSI chip. Those skilled in the art may readily construct such a large scale integrated circuit chip from the following descriptions.

Referring now more particularly to FIG. 2, the specific embodiment employed for purposes of describing the invention is adpated for use with an electronic musical instrument of the keyboard type. Moreover, the illustrated embodiment is intended specifically for use with eight keys of such a keyboard instrument, to independently generate a separate envelope waveform for the respective tone associated with each key. The invention is not so limited, however, the choice of eight keys being primarily for convenience of illustration. Accordingly, the input circuit 10 illlustrated in FIG. 2 is but one of eight identical such input circuits, one such circuit being associated with each of the eight keys. The remaining circuits (FIGS. 3–9), however, are utilized singly, as illustrated, not being repeated for each key.

In accordance with conventional practice, a key-operated switch 40 is provided which is movable by the player between a normally open terminal (NO) and a normally closed terminal (NC). Thus, upon actuation of the instrument by player to initiate a note, one or more key-switches such as the key-switch 40 will be actuated by the player from its normally closed (NC) position to its normally open (NO) position. The NO and NC terminals each feed the input circuit 10 at a respective inverter 42, 44, each of which is provided with a suitable pull-up resistor 43, 45 to a positive supply. These inverters 42 and 44 feed the inputs of a two-input OR gate 46 which in turn feeds one input of a two-input NOR gate 48. The inverter 44 also feeds a further similar inverter 50, which feeds the clear or reset input of a flip-flop integrated circuit 52. The inverter 22 feeds the clock input of the flop-flop 52. The inverter 44 also feeds the reset input of a counter circuit 54, which in the illustrated embodiment is an integrated circuit of the type generally designated 74LS93.

The NOR gate 48 delivers its output to one input of a two-input AND gate 56 which receives its remaining input from a terminal 58, (Interval) and delivers its output to the clock input of the counter 54. The remaining input of the NOR gate 48 is received from a two-input OR gate 60 which has one input fed from the Q output of the flip-flop 52 and its other input fed from a five-input NAND gate 62 through an inverter 64. The counter 54 is wired as a four-bit binary counter, having its four output lines delivered to four of the inputs of five-input NAND gate 62. A fifth bit is facilitated by the provision of a suitable flip-flop 66 receiving the most significant bit or output line of the counter 54 and having its Q output wired to the fifth and final input of the NAND gate 62.

The four bits of the outputs of counter 54 and the fifth bit from the Q output of the flip-flop 66 also feed the inputs of a five-bit latch 68 whose outputs are designated generally 70. In the illustrated embodiment, this latch comprises an integrated circuit of the type generally designated 74LS174. The clear or reset input of the flip-flop 66 is fed from inverter 50, simultaneously with the similar clear input of the flip-flop 52 as already described. The Q output of flip-flop 52 feeds the clock input of a similar flip-flop 72 whose Q and $\overline{Q}$ outputs signal a pair of circuit output leads 74, 76, and comprise enable control signals. The Q output of flip-flop 52 also feeds the clock input of the latch 68. The Q output of flip-flop 72 also forms one input to a two-input AND gate 78 whose opposite input is received from a two-input OR gate 80. The AND 78 feeds an output line 77.

A pair of similar two-input AND gates 82 and 84 feed the respective inputs of the OR gate 80. The AND gate 82 is fed from an external clock, designated the normal (NORM) clock, while the AND gate 84 is fed from a similar external clock, designated the fast (FAST) clock. The remaining inputs of the AND gates 82 and 84 are respectively fed opposite sense signals from the respective input and output sides of an inverter 86. This inverter 86 receives its input from a two-input AND gate 88 which has one input fed from the $\overline{Q}$ output of the flip-flop 52 and the opposite input fed from a normally open terminal of a sustain switch 90. The normal clock and the fast clock each provides a chain of timing pulses at a predetermined rate, the fast clock pulses being at a relatively faster rate as will be hereinafter discussed.

The fast clock input also feeds one input of a three-input AND gate 92 which has a second input from the Q output of the flip-flop 52. The AND gate 92 feeds the clock input of a further flip-flop 94 whose $\overline{Q}$ output is fed back to the remaining input of the AND gate 92. The clear or reset input of the flip-flop 94 is fed from the Q output of the flip-flop 52. The output of AND gate 92 is also tied to one input of a two-input OR gate 96, whose remaining input receives the Q output of a flip-flop 98. This flip-flop 98 receives its clear input from the Q output of the flip-flop 72, while its $\overline{Q}$ output feeds the clear or reset input of flip-flop 72.

The output of the AND gate 78 forms the count input of a counter circuit 100, which together with a similar counter circuit 102 forms an envelope counter whose output is the envelope count signals. This output of the AND gate 78 also provides the envelope control signals on the line 77, which forms one of the lines 14 of FIG. 1. In the illustrated embodiment, the counter circuits 100 and 102 are of the type generally designated 74LS93, and are wired together to form an eight-bit counter circuit. The output of OR gate 96 is tied to the reset terminals of both counters 100 and 102. The four-bit outputs of the counter 102 are wired, respectively, to the inputs of a four-input AND gate 104, whose output feeds the clock input of flip-flop 98. The eight outputs of counters 100 and 102 are designated X0, X1, X2, X3, X4, X5, X6 and X7, and form a portion of the lines 15 of FIG. 1.

Having described the structure of the input circuit of FIG. 2, it will be advantageous to briefly describe the operation thereof. Prior to player actuation of the keyoperated switch 40, this switch 40 will be engaged with its normally closed (NC) contact. It will be noted that the center contact of the switch 40 is connected to ground. Thus, the input of inverter 42 is high or logic 1 while the input of inverter 44 is low or logic 0. As used hereinafter, and as generally understood in digital circuit technology, "logic 1" and "logic 0", or alternatively, "high" and "low" refer to selected upper and lower D.C. voltage levels. Accordingly, with the input of inverter 44 low, its output will be high and consequently the output of series connected inverter 50 will be low. This low logic level at the inputs of flip-flops 52 and 66 will cause their Q outputs both to be low (logic 0). This of course also causes the opposite sense or a logic 1 signal on the $\overline{Q}$ output of the flip-flop 52. The Q output of flip-flop 52 causes the output of AND gate 92 to go low and also clears flip-flop 94 causing its $\overline{Q}$ output to go high.

The high logic level at the output of inverter 44 also resets counter 54 causing its four outputs to all go low, such that the inputs of NAND gate 62 are at a low logic level, causing its output to go high. It will be seen that the logic gates 46, 48, 60 and 56 are therefore held at suitable logic levels so that the signals at the input terminal 58 are inhibited or prevented by the gate 56 from driving the counter 54.

Upon actuation of the key-operated switch 40 by a player of the instrument, the NC contact will be open circuited, causing a high or logic 1 signal at the input of inverter 44. The NO terminal will also remain open circuited, initially. The former condition removes the clear signals from flip-flops 52 and 66 and the reset from counter 54, thus enabling all of these components. The resulting logic levels at gates 46 and 48 are thus altered, so as to allow the signal at input 58 to be fed, by the action of AND gate 56, to the counter 54. The nature of this input signal at terminal 58 will be described later. Suffice it now to say that this comprises a clock signal or chain or pulses at a predetermined frequency, for driving the counter 54.

As the travel of the key-operated switch 40 progresses, the normally open (NO) contact will eventually become closed. The time interval in which this takes place of course depends on the intensity (and more particularly upon the velocity) with which the player actuates the key. When the NO contact becomes closed, the input of inverter 42 goes low, driving its output high, thus again changing the logic signals through the gates 46 and 48 to again inhibit the clock signals at terminal 58, at the gate 56. Thus, it will be recognized that the output state or count reached by the counter 54 will be inversely proportional to the intensity or velocity of actuation of the key-operated switch 40 by the player of the instrument.

This low-to-high transition at the output of inverter 42 also clocks the flip-flop 52, causing a high at its Q output and a low on its $\overline{Q}$ output. This results in suitable logic levels for again disabling the clock signal on terminal 58 at the gate 56. This second disabling prevents the clock signals from being fed through the counter 54 inadvertently, should contact bounce be encountered at the NO terminal, and to prevent the enabling of gate 56 upon release of the key-operated switch 40. It will be noted that should the output of counter 54 and the additional bit thereof provided by flip-flop 56 reach the maximum count, the output of NAND gate 62 would then go low, also disabling the clock signal from terminal 58 via inverter 64 and gates 60, 48 and 56. The low to high transition at the Q output of flip-flop 52 also causes clocking of flip-flop 72 to drive the output line 74 high and the output line 76 low. The signal at line 74 is called the enable signal and will be further utilized in succeeding circuits.

The high transition of the Q output of flip-flop 52 also provides a clock pulse to the clock input of the latch 68 so that the output state or count reached by the counter 54 is now latched at the outputs 70 thereof. This count is a five-bit number or signal, which comprises the scaling control signal. Hence, the lines 70 are individually designated s0, s1, s2, s3, and s4.

With the Q output of flip-flop 52 high, the connected input of AND gate 94 is also high, such that its output follows its input joined to the fast clock. However, only a single positive-going pulse therefrom will be produced from the output of AND gate 92, since the negative-going edge of that first pulse will clock the flip-flop 94 causing its $\overline{Q}$ output, which is joined with the remaning input of AND gate 92, to go low thus disabling the AND gate 92. The purpose of this single pulse is to reset the counters 100 and 102 via the OR gate 96.

The envelope counter 100, 102 then counts the pulses admitted at the AND gate 78, from 0 to 240, in eight-bit digital form. At the 240th count, all four inputs to AND gate 104 are high, so that AND gate 104 clocks the flip-flop 98, thereby resetting the counters 100 and 102. At the same time, the flip-flop 98 will feed a low signal to clear flip-flop 72 causing the output line 74 to go low and the output line 76 to go high. This low signal at output line 74 also provides a clear to flip-flop 98, causing the reset to be removed from the counter circuits 100 and 102. However, the counter remains at zero since the input thereto at gate 78 is disabled by the low signal on line 74.

This clock signal fed by gate 78 to the envelope counter 100, 102 comprises either the normal or the fast clock signal, as determined by the logic signals at the gates 80, 82, 84, 86 and 88. When the NO contact of switch 40 is closed, the flip-flop 52 sends a low signal to AND gate 88, thus disabling the fast clock signal at the gate 84 and enabling the normal clock signal at the gate 82, assuming the sustain switch 90 remains open. Thus, gate 80 feeds the normal clock signal to the envelope counter 100, 102 via AND gate 78. When the NC contact is closed, however, the fast clock signal is fed through, in similar fashion. When the sustain switch 90 is closed it will result in the normal clock signal being fed through without regard for the position of the key-operated switch 40 (i.e., as far as AND gate 78).

It will be remembered that the eight output lines of the counters 100, 102, designated x0–x7, inclusive carry the envelope count signals described above with reference to FIG. 1.

Figures 3, 4:
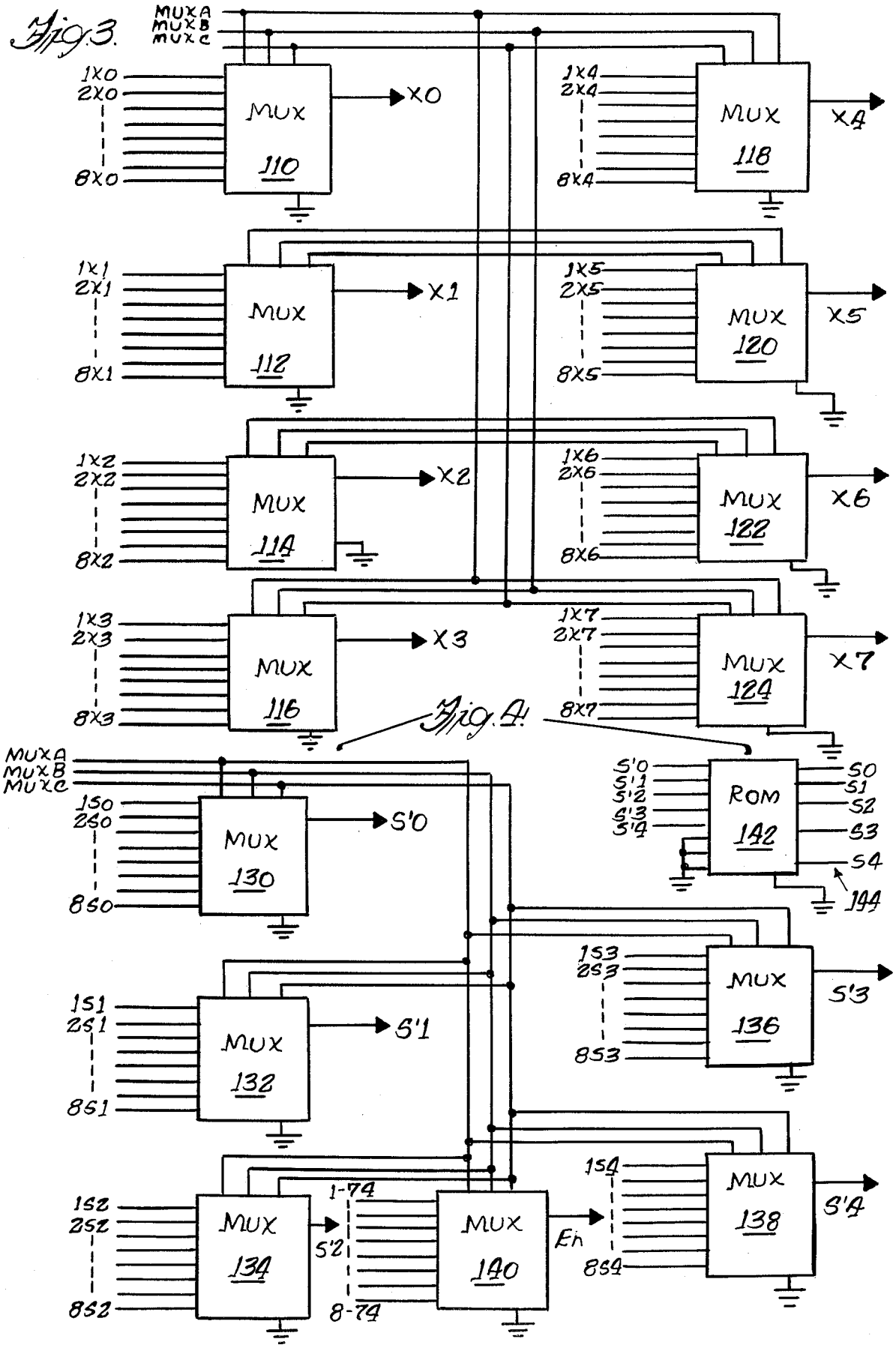

Reference is next invited to FIG. 3, wherein there is seen a multiplexing circuit for use with the illustrated embodiment. As mentioned above, the embodiment of the invention illustrated herein is specifically adapted for use with eight keys of a keyboard musical instrument, so as to independently develop a suitable envelope waveform for each such key. Accordingly, the circuit of FIG. 3, which is part of the envelope control circuits 18 of FIG. 1, permits timesharing of components by serially multiplexing the envelope count signals from the circuit of FIG. 2 and seven other similar circuits. Accordingly, the lines x0 through x7, of the circuit of FIG. 2 as well as similar lines from the seven other similar input circuits of the illustrated embodiment are fed to the inputs of eight multiplexer circuits 110, 112, 114, 116, 118, 120, 122 and 124. In the illustrated embodiment, each of these multiplexers is an integrated circuit of the type generally designated 74LS151. These inputs are designated by the numbers x0 through x7, each prefixed by a further number indicating the one of the eight input circuits with which it is associated. The eight-bit multiplexed outputs from these multiplexer circuits are designated X0 through X7, inclusive.

Reference to FIG. 4 reveals a multiplexing circuit arrangement similar to FIG. 3, but intended for serially multiplexing the scaling control signals from the lines 70 of latch 68 and for serially multiplexing the enable signals on the lines 74, for each of the eight input circuits, typified by FIG. 2, of the illustrated embodiment. The circuit of FIG. 4 develops the digital scaling signal mentioned earlier. Multiplexer circuits 130, 132, 134, 136, 138 and 140 are, in the illustrated embodiment, of the type generally designated 74LS151. A ROM 142 is also utilized for developing the digital scaling signal, and in the illustrated embodiment is of the type generally designated MM5202. Briefly, the five outputs 70 of the latch 68 represent a five-bit scaling control number, the bits being designated by the outputs s0, s1, s2, s3, and s4. These s0 through s4 outputs of each input circuit, as designated by their prefixes in FIG. 4, are fed in serial fashion to the multiplexers 130, 132, 134, 136 and 138 in similar fashion to the handling of the x outputs by the circuit of FIG. 3. Similarly, the eight enable lines 74 of the eight input circuits are fed to the multiplexer 140, whose output forms an enable (En) line.

The outputs of the multiplexers 130–138, inclusive are designated as s′ outputs. These s′ outputs are fed to respective addressing inputs of the ROM 142, which outputs a suitable, preprogrammed, five-bit scaling signal on output lines designated generally 144. These output lines 144 are therefore labeled S0, S1, S2, S3 and S4. It will be recognized that the use of ROM 142 permits a predetermined five-bit scaling number to be assigned for a given intensity of player actuation of the instrument, the intensity being determined by the count of counter 54 latched at latch 68 of the input circuit 10.

Multiplex control lines MUXA, MUXB and MUXC feed the three control inputs of the multiplexers 110 through 124, and also of the multiplexers 130 through 140, as indicated in FIGS. 3 and 4.

Figure 5:
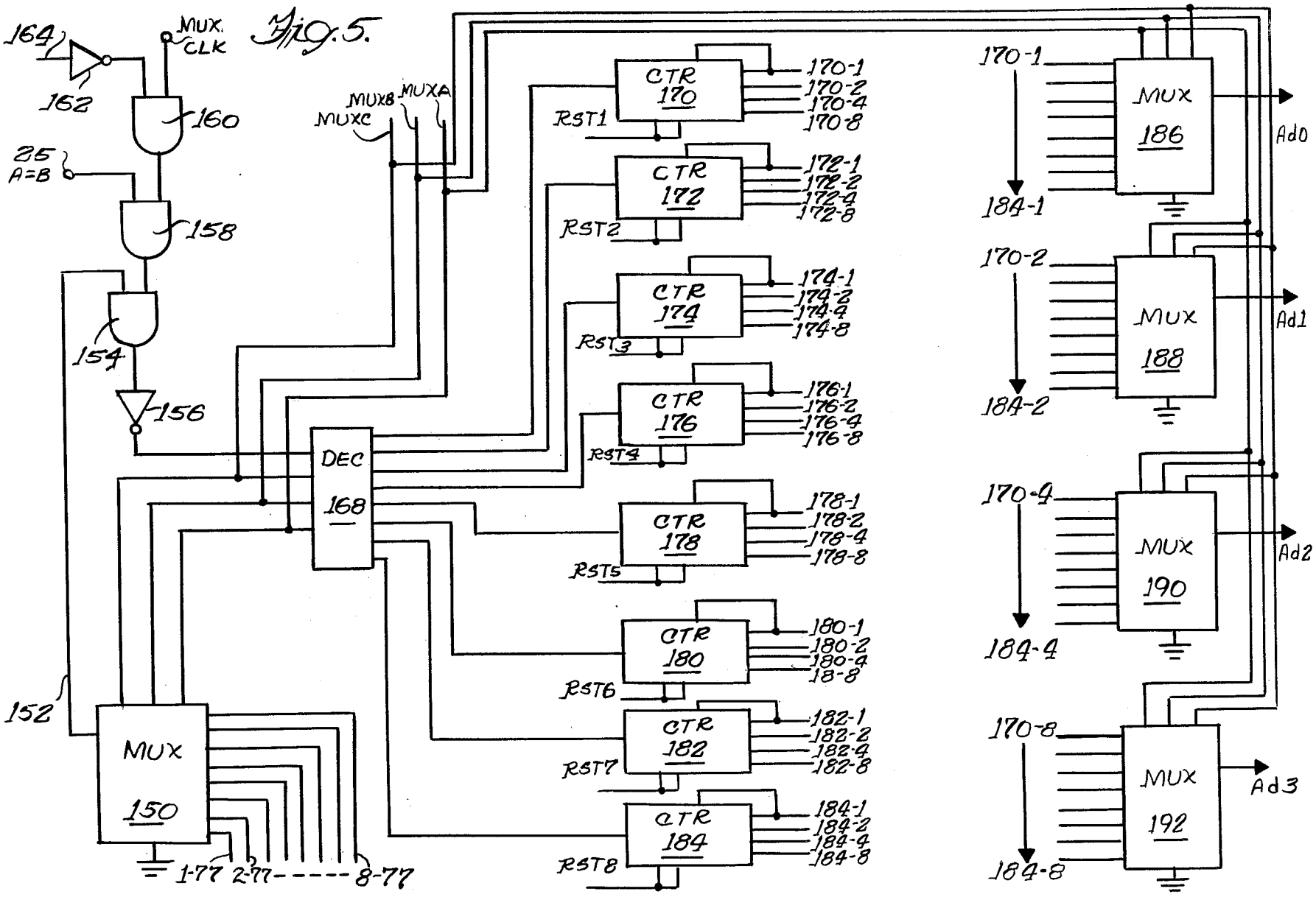

Reference is next invited to FIG. 5, wherein there is illustrated another portion of the envelope control circuits 18 of the illustrated embodiment. The output lines 77 of the eight input circuits, here designated by prefixes 1-77, 2-77, etc., are fed to the eight inputs of a multiplex circuit 150, which serially multiplexes the signals on these lines to its output 152. This output 152 feeds one input of a two-input AND gate 154 which in turn feeds an inverter 156. A suitable control signal is derived for the remaining input of AND gate 154 by a logic network comprising an AND gate 158, an AND gate 160, and an inverter 162. The inverter 162 receives a control signal at a terminal 164, whose derivation will be discussed later. Similarly, the control signal on the line 25, which signal will also be described later, feeds one input of the AND gate 158. The remaining input of the AND gate 158 is fed from the output of AND gate 160, one input of which is fed from a MUX CLOCK control line. The MUXA, MUXB and MUXC control lines feed the control inputs of the multiplexer 150.

The inverter 156 feeds one input of a decoder circuit 168, whose remaining three inputs are fed by the MUXA, MUXB and MUXC control lines. In the illustrated embodiment, the decoder 168 is an integrated circuit of the type generally designated 74LS42, used as a three-line-to-eight-line decoder. The eight outputs of the decoder circuit 168 feed respective inputs of eight similar counter circuits 170, 172, 174, 176, 178, 180, 182 and 184, which in the illustrated embodiment are of the type generally designated 74LS93, and are wired as four-bit binary counters. Thus, the multiplex control signals MUXA, MUXB and MUXC are decoded through to the eight counters 170 through 184, inclusive, as controlled by the signal derived at the output of the inverter 156. Suitable reset signals are also provided at reset lines designated RST1 through RST8, inclusive, of the counters 170 through 184. The reset signals for the counters 170 through 184 are taken from the respective output lines 76 of the eight input circuits (e.g. the circuit of FIG. 2). These eight counters 170 through 184 each have four outputs, which are fed in serial fashion to the input of four multiplexer circuits 186, 188, 190 and 192. In the illustrated embodiment, these multiplexers 186 through 192, as well as the multiplexer 150 are all integrated circuits of the type generally designated 74LS151. More specifically, the outputs of the counters 170 through 184, are designated, in binary fashion, 170-1, 170-2, 170-4, 170-8, and similarly for the remaining counters. It will be seen by reference to FIG. 5 that all of the $-1$ outputs are fed to the multiplexer 186, the $-2$ outputs to multiplexer 188 and so on such that the outputs of the multiplexers 186 through 192 each comprise one serially multiplexed bit from the eight counters 170 through 184. The outputs of multiplexers 186 through 192 form address lines, designated Ad0, Ad1, Ad2, and Ad3.

Figure 6:
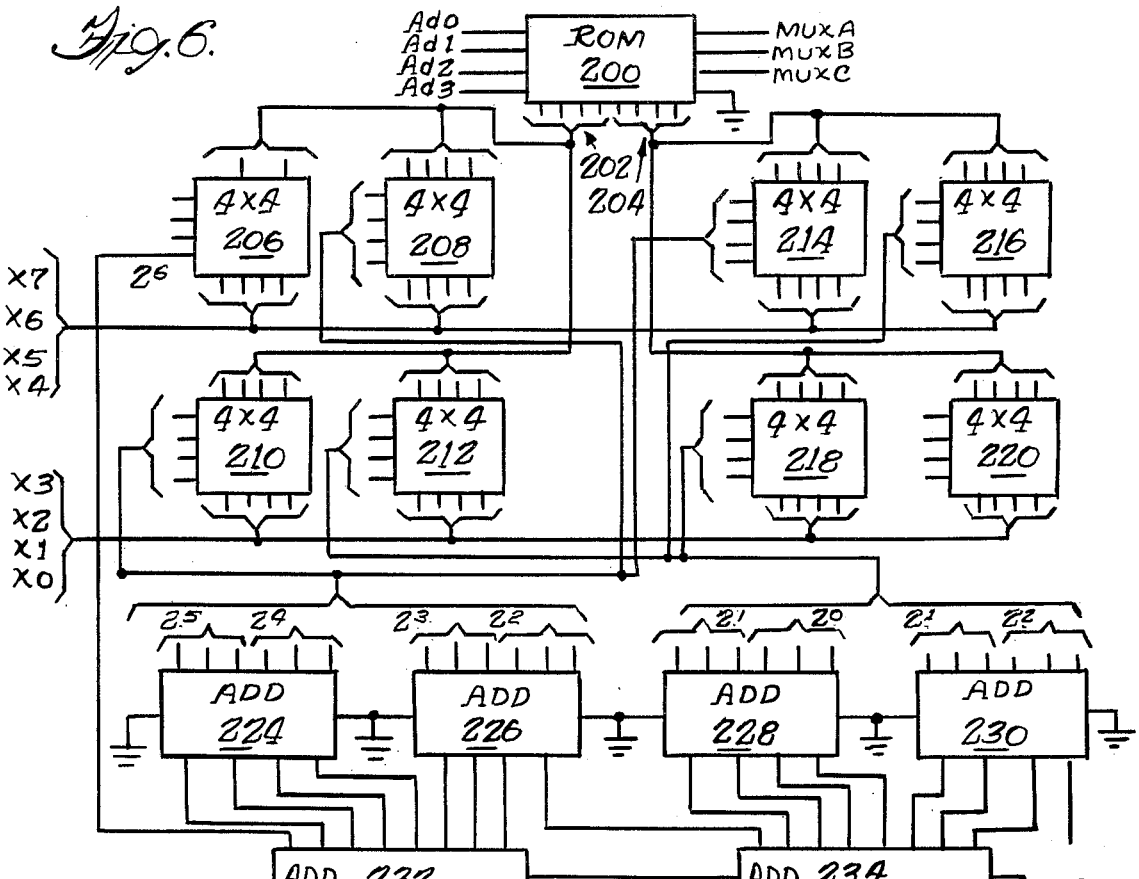

Referring now to FIG. 6, a first portion of the arithmetic circuit 24 is illustrated. The circuits of the invention produce envelope signals of the general form $S(B \pm MX)$, where S is a scaling number, B is the intercept and M is the slope, in an x-y coordinate representation of the envelope waveform. In this regard, there are provided sixteen sets of parameters B and M for each envelope (i.e. each note) to be generated. Thus each envelope comprises sixteen short, straight line segments when viewed in an orthogonal coordinates representation. The circuit of FIG. 6 performs, in binary form, the operation MX, as a first step in deriving the output signal represented by the expression $S(B \pm MX)$, as described above. A ROM 200 holds stored, selected values of M for each note of the eight notes handled by the system of the illustrated embodiment. This ROM 200 forms a part of the envelope control circuit 18 of FIG. 1 and is addressed by the address lines Ad0, Ad1, Ad2, and Ad3, from the circuit of FIG. 5, and by the MUXA, MUXB, and MUXC control lines. The ROM 200 has an eight-bit output comprising the selected number M, over two groups of four lines designated generally 202 and 204. In the illustrated embodiment these values of M are in 8-bit binary form, the last 6 bits being fractional. Hence, M is of the form $2^1\ 2^0\ 2^{-1}\ 2^{-2}\ 2^{-3}\ 2^{-4}\ 2^{-5}\ 2^{-6}$.

The outputs 202 carry, in order, the most significant bits, while the outputs 204 are ordered as the least significant bits. These outputs 202 and 204 are fed to the first four and last four, respectively, of eight similar multiplier integrated circuits 206, 208, 210, 212, 214, 216, 218 and 220 each of which is wired as a four-bit-by-four-bit multiplier. In the illustrated embodiment, the circuits 206, 210, 214 and 218 are of the type generally designated 74284 while the remaining multiplier circuits 208, 212, 216 and 220 are of the type generally designated 74285. The eight-bit X signal on lines X0, X1, etc., is fed to the multipliers 206 through 220, as indicated at the right-hand side of FIG. 6, the X0 through X3 bits being fed to multipliers 210, 212, 218 and 220 and the X4 through X7 bits being fed to multipliers 206, 208, 214, and 216. Accordingly an eight-bit by eight-bit multiplication is carried out by use of these multipliers 206 through 220 inclusive. The outputs of these four-bit-by-four-bit multipliers 206 through 220, inclusive, are fed to the inputs of four, four-bit full adders 224, 226, 228, and 230, which in the illustrated embodiment are of the type generally designated 74LS83.

It will be noted that the outputs of the multipliers 206 through 220 form a 9-bit binary encoded signal, the last two bits of which are fractional bits. These outputs are joined as indicated by respective powers of two at each input of adders 224 through 230. It will be noted further that the outputs of multiplier 220 are not utilized, as they are lower order, fractional bits. Similarly, three of the outputs of multiplier 206 are higher order bits which are not used.

The adders 224 through 230 feed the inputs of two further similar adders 232 and 234 which in the illustrated embodiment are of the type generally designated 74LS83. The outputs of these adders, designated generally 236, form the eight-bit product (MSB through LSB) of the multiplication of $M \cdot X$, the least significant bit (LSB) being a fractional bit.

Figure 7:
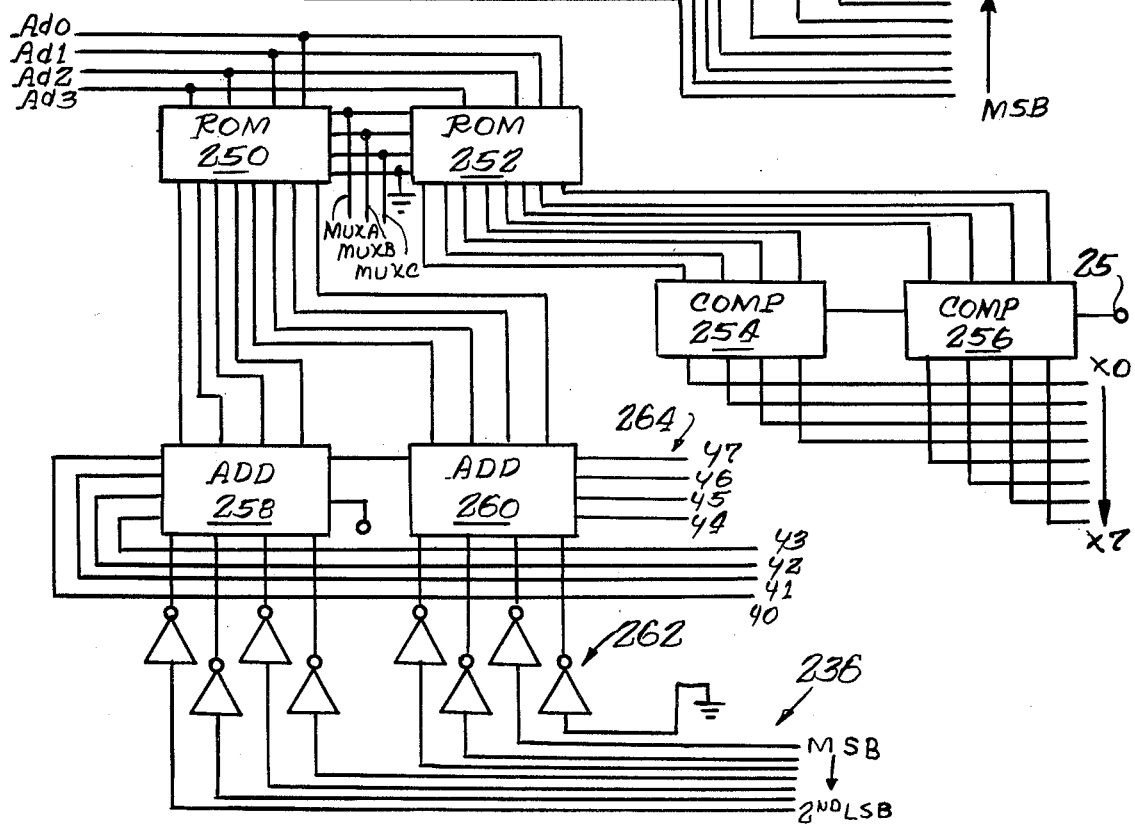
Figure 8:
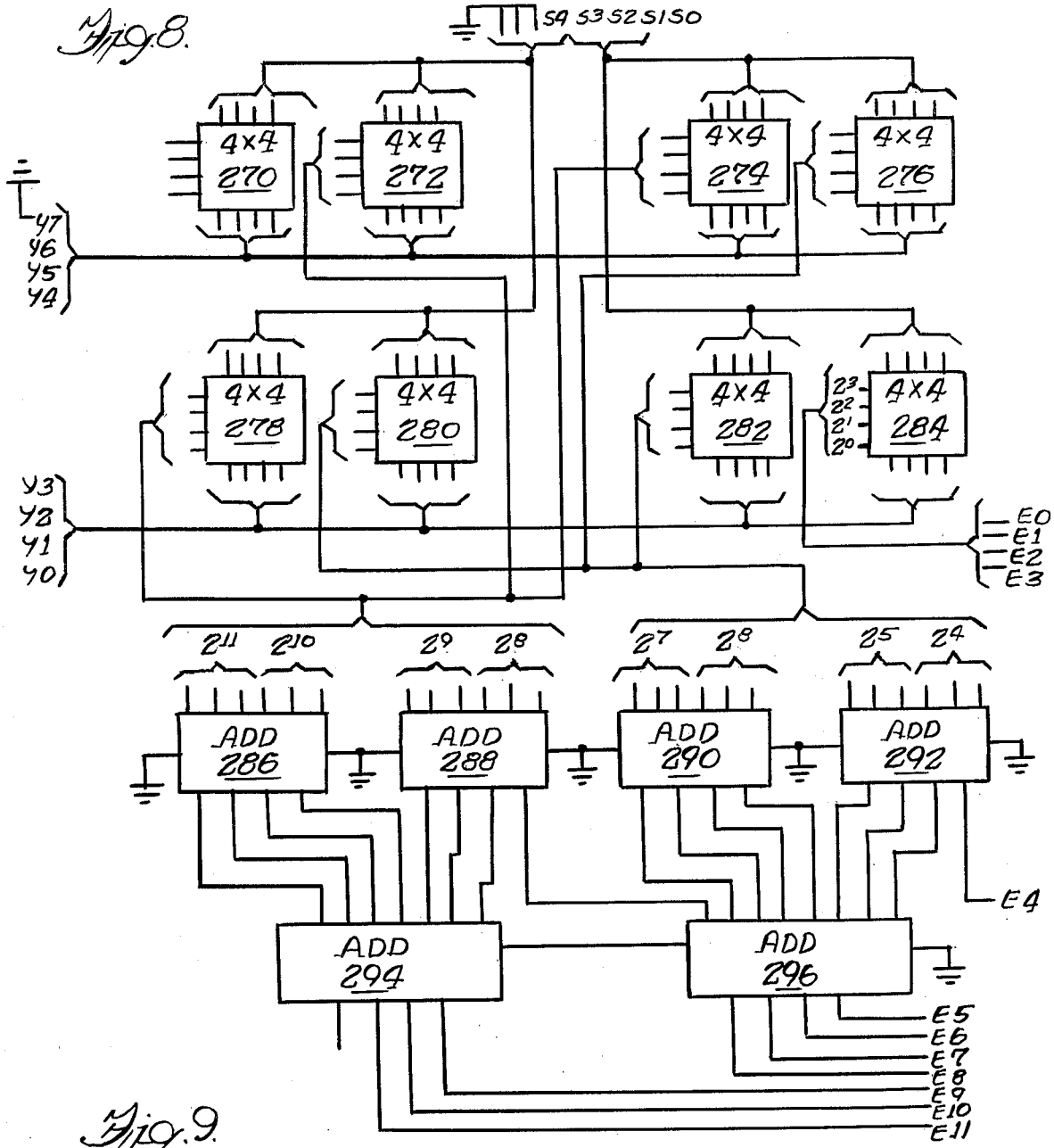

Additional portions of envelope control circuits 18 and of arithmetic circuit 24 are illustrated in FIG. 7 and FIG. 8. In the embodiment illustrated for purposes of description, the circuit of FIG. 7 performs a binary subtraction, thereby deriving the decay portion of an envelope waveform in accordance with the general expression $B-MX$. It will become apparent that a simple modification of the logic thereof would render this circuit an adder circuit for deriving the ascending or attack portion of such an envelope. Referring now more particularly to FIG. 7, a pair of ROMs 250 and 252, which are similar to the ROM 200 of FIG. 6, provide the remaining signals for the expression $(B \pm MX)$ of the envelope. The ROM 250 stores eight-bit signals comprising the intercept or B term of the expression. The ROM 252, in accordance with another feature of the invention, stores a maximum value of X for each envelope to be produced. In similar fashion to the ROM 200 of FIG. 6, the ROMs 250 and 252 are simultaneously addressed by the address lines Ad0, Ad1, Ad2, Ad3 and by the multiplex control lines MUXA, MUXB, and MUXC, as illustrated.

The eight-bit output of the ROM 252, representing the maximum X value for each key or note of the eight keys or notes accommodated by the illustrated embodiment, feeds respective first compare inputs of a pair of four-bit comparator circuits 254 and 256. The second compare inputs of these comparators receive the eight-bit X number from the multiplexer circuit of FIG. 3, X0 through X7, as indicated. The output of the comparators 254 and 256 forms the control signal at line 25, as mentioned previously with reference to FIG. 5. Thus, when the serially advancing binary X count reaches the preselected maximum X value stored in ROM 252 for a given note, the compare signal is given, enabling operation of the circuit of FIG. 5, via the control line 25. This, in effect, signals the system of the invention that production of that particular envelope segment is complete.

The eight-bit output of ROM 250 is fed to one set of inputs of each of a pair of four-bit adder circuits 258 and 260, which in the illustrated embodiment are four-bit adders of the type generally designated 74LS83. The other set of inputs of each of these adder circuits 258, 260 receives the MX signal from the lines 236, MSB through LSB as indicated, via eight interposed inverter buffers, designated generally 262. It will be recognized that provision of these inverters causes the addition process carried out in the adders 258 and 260 to be, in effect, a subtraction as the signs or senses of the signals at lines 236 are reversed by the inverters 262. The outputs of adders 258 and 260 are designated generally by reference numeral 264 and individually by numbers Y0 through Y7, indicating least significant bit through most significant bit. This "Y" signal is the result of the mathematical operation B-MX.

Reference is next invited to FIG. 8, wherein a multiplier circuit similar to the circuit of FIG. 6 performs the scaling operation, by multiplying the digital scaling signal or number S, as derived in the circuit of FIG. 4, by the digital signal or number Y derived as explained above. It will be appreciated that this operation forms the ultimate envelope output signals of the circuits of the invention, of the forms S(B±MX).

Eight four-bit-by-four-bit multiplier circuits 270, 272, 274, 276, 278, 280, 282 and 284 have first multiplied inputs fed by the scaling signal on lines S0 through S4, as indicated, which are from the ROM 142 of the circuit of FIG. 4. The remaining first multiply inputs of each of the multipliers 270 through 284 are tied to ground. The output signals from the circuit of FIG. 7, Y0 through Y6, are fed to the other multiply inputs of each of the multipliers 270 through 284, as indicated at the left hand side of FIG. 8. Four adders 286, 288, 290 and 292 receive the outputs of multipliers 270–284, the respective bits of these outputs being indicated at the respective adder inputs by powers of two, in similar fashion to the method utilized in FIG. 6. These adders 286, 288, 290 and 292 feed further adders 294 and 296, in similar fashion to the operation of FIG. 6. The final or resultant output signal of the circuit of FIG. 8 comprises a twelve-bit binary signal or number on twelve output lines designated by the reference characters E0 through E11, from most significant bit through least significant bit. It will be noted that the four least significant bits are taken directly from the output of the multiplier 284, the next most significant bit being taken directly from the output of adder 292 while the remaining seven bits are taken from the outputs of the adders 294 and 296.

Figure 9:
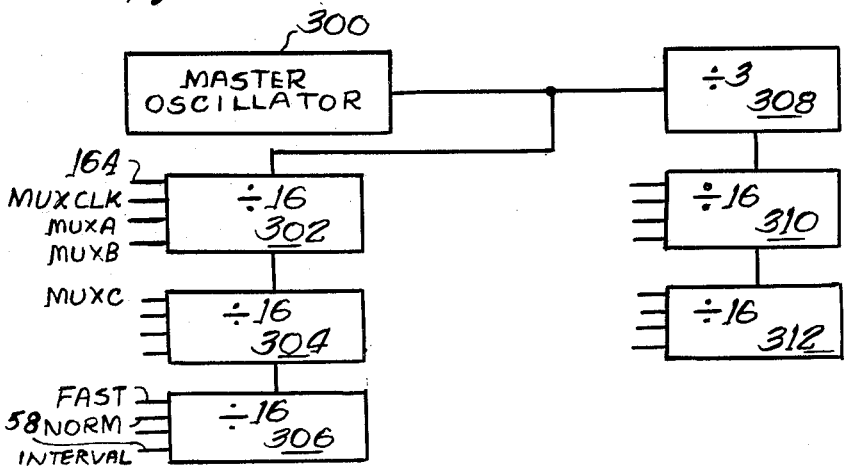

The various timing control signals used through the circuits of the present invention are provided by the clock circuits 20, which are illustrated in FIG. 9. A master oscillator 300 feeds a first chain of divider integrated circuits 302, 304 and 306 and a second chain of divider circuits 308, 310 and 312. The frequency of the master oscillator may be controlled as desired in any one of a number of fashions generally known in the art, and in the illustrated embodiment has been chosen at substantially 400 Khz. It will be seen that the first divider is a divide-by-sixteen, the outputs thereof therefore being substantially 200 Khz, 100 Khz, 50 Khz and 25 Khz, respectively. The first output comprises the control signal at terminal 164, mentioned above with reference to FIG. 5, which is substantially half of the master oscillator frequency. The next three succeeding outputs of divider 302 and the first output of the next succeeding divide-by-sixteen divider 304 provide the multiplex control signals MUXA, MUXB, MUXC and MUX CLK.

In the illustrated embodiment, the normal clock signal and fast clock signals forming the inputs of gates 82 and 84 of FIG. 2, are taken from suitable outputs of these divider chains of FIG. 9, or otherwise derived therefrom, to provide suitable frequency signals. Similarly, the clock signal at input terminal 58 of each input circuit 10, as shown in FIG. 2, is taken or derived from the circuit of FIG. 9. In the illustrated embodiment, the clock signal for the terminal 58 is substantially on the order of 50 hertz, while the normal clock is substantially between 5 hertz and 600 hertz, the fast clock being chosen at a greater value than the normal clock substantially between the frequencies of 100 hertz and 2 Khz. Other frequencies for these signals may be chosen without departing from the principles of the invention.

From the foregoing, it will be seen that the novel circuits of the invention permit independent presetting or preselection of a separate envelope waveform for each note or key of the keyboard instrument with which the illustrated embodiment is intended to cooperate. Each of these waveforms is defined by a series of twelve-bit digital or binary encoded output signals at the "E" outputs of FIG. 8. As will be readily seen from the foregoing descriptions, the digital or binary encoded signals thus generated are generally of the form S(B±MX) where S is a digital scaling number, B is a Y intercept and M is a slope, when the waveform is expressed by an x-y coordinate system. Advantageously the scale factors S are preselected to bear a desired relationship to the intensity of player actuation of the instrument. Similarly, the Y intercepts (B) and the slopes (M) are also preselected for each count or interval X, by storing suitable binary codes in in the respective ROMs 200 and 250 of FIGS. 6 and 7 described above. Thus, the slope and intercept of each digital signal of the series which defines the envelope waveform may be varied, in accordance with the codes stored by these memory components, together with the integrally advancing count "X", thereby producing virtually any desired waveshape. In this regard, it will be noted that these digital envelope signals are generated in a step-by-step or counted fashion, in accordance with the "X" outputs or count of the counters 100, 102 of the input circuits. Furthermore, the overall length in time (i.e. the x-axis) of the waveshape may be selectively varied by the setting of the maximum X value, which is accomplished by the binary codes stored in the ROM 252 of FIG. 7. Further, this series of digitally generated, binary encoded envelope signals is scaled in accordance with the intensity of the actuation of the instrument by the player. Advantageously, then, the envelope characteristic of virtually any type of conventional musical instrument may be emulated by the system of the invention. Moreover, certain synthesized envelope waveforms may also be readily generated by suitable presetting of the system of the invention.

An alternate embodiment of portions of the circuits thus far described is illustrated in FIGS. 10 through 13, inclusive.

In this alternate embodiment, the input circuits 10 illustrated in FIG. 2 remain essentially unchanged, as do the circuits of FIGS. 3 and 4. However, the number or value X becomes a seven-bit number in this alternate embodiment, rather than the eight-bit number described above. Accordingly, the last bit outputs of counter 102 of FIG. 2 and of the multiplexer 124 of FIG. 3 are not utilized. Additionally, the multiplexer 140 of FIG. 4 is eliminated, as will be seen later with reference to FIG. 11*b*. In FIG. 5, multiplexers 186, 188, 190 and 192 are utilized as already described to derive the address codes Ad0 through Ad3. However, FIG. 10 illustrates an alternate embodiment of the remainder of the circuitry of FIG. 5.

Figure 10:
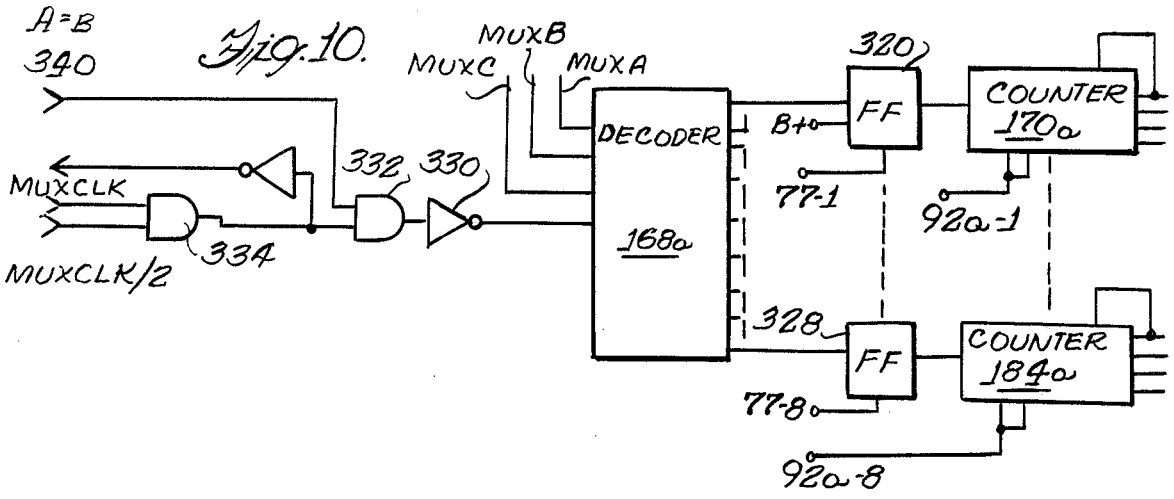
FIGS. 10, 11A and 11B, 12 and 13 are schematic circuit diagrams of portions of an alternative embodiment of the invention.

Referring now to FIG. 10, it will be seen that a decoder 168*a* and a group of eight counters 170*a* through 184*a*, inclusive, are utilized, and are essentially the same as the components 168 and 170 through 184, inclusive, illustrated and described above with reference to FIG. 5. However, a group of eight flip-flops 320 through 328, inclusive, are interposed between respective outputs of the decoder 168*a* and the counters 170*a*, through 184*a*, respectively. To avoid unnecessary repetition, the diagram of FIG. 10 illustrates only the first and last of these flip-flops 320 through 328, and only the first and last of the counters 170*a* through 184*a*. The outputs of counters 170*a* through 184*a* feed the multiplexers 186 through 192, in the same fashion illustrated and described above with reference to FIG. 5.

Briefly, then, each output of decoder 168*a* feeds a clock input of one of the flip-flops 320 through 328, whose Q output feeds an associated one of the counters 170*a* through 184*a*. The clear inputs of the flip-flops 320 through 328, inclusive receive the respective lines 77 associated with the eight input circuits, each of which take the form illustrated in FIG. 2. Similarly, the reset inputs of each of the counters 170*a* through 184*a* receives the output of the AND gate 92 of an associated one of the eight input circuits of the form illustrated in FIG. 2. Accordingly, the clear inputs of flip-flops 320 through 328 are labeled 77-1 through 77-8, while the reset inputs of counter 170*a* through 184*a* are labeled 92*a*-1 through 92*a*-8.

Decoder 168*a* receives the multiplex control lines MUXA, MUXB, and MUXC, and the output of an inverter 330. This inverter 330 is fed from the output of a two-input AND gate 332 whose inputs are fed from a line 340 and from the output of a further two-input AND gate 334. The AND gate 334 receives two multiplex control inputs MUX CLK and MUX CLK/2. The derivation of the signals at terminals 340, MUX CLK and MUX CLK/2 will be described hereinbelow.

Figure 11A:
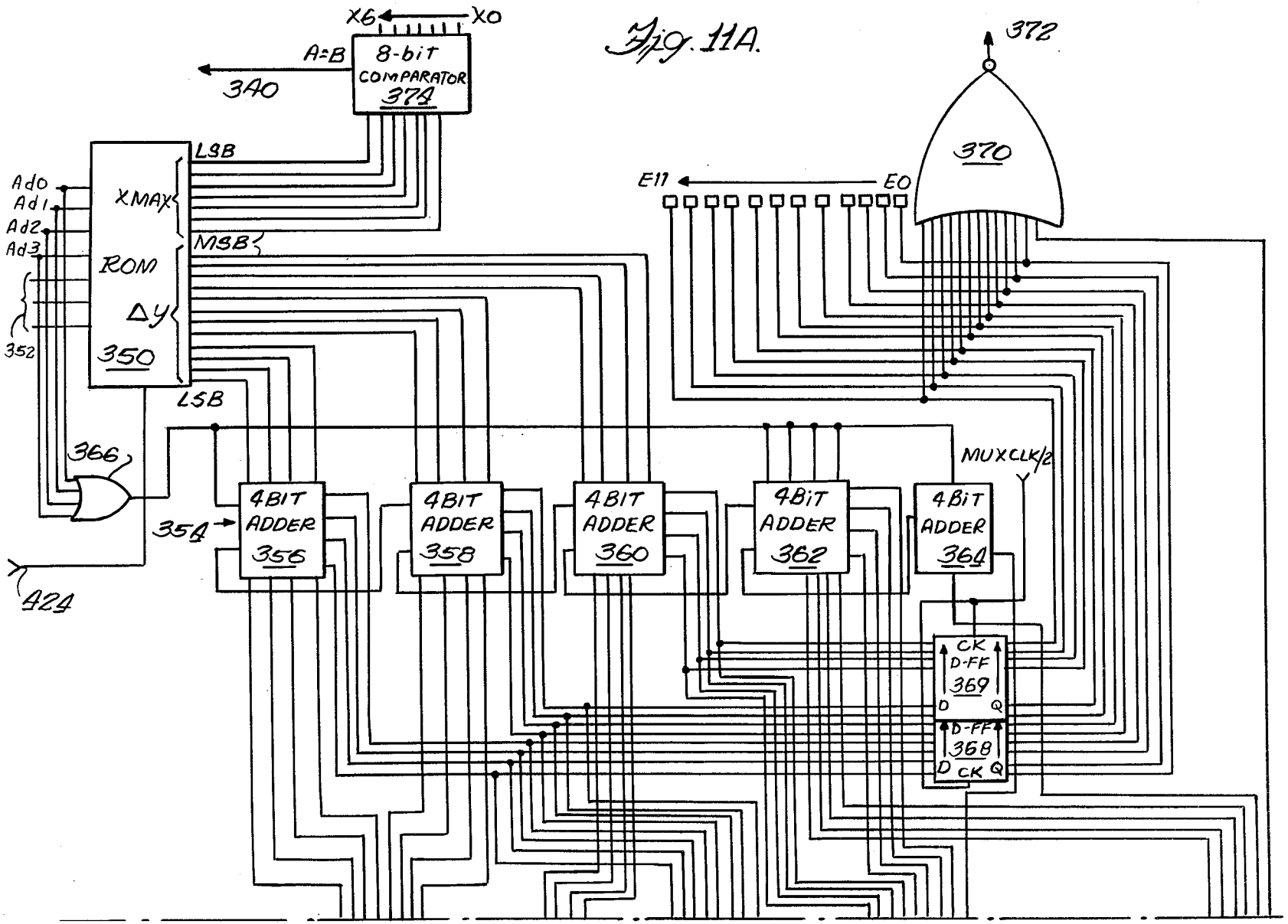
Figure 11B:
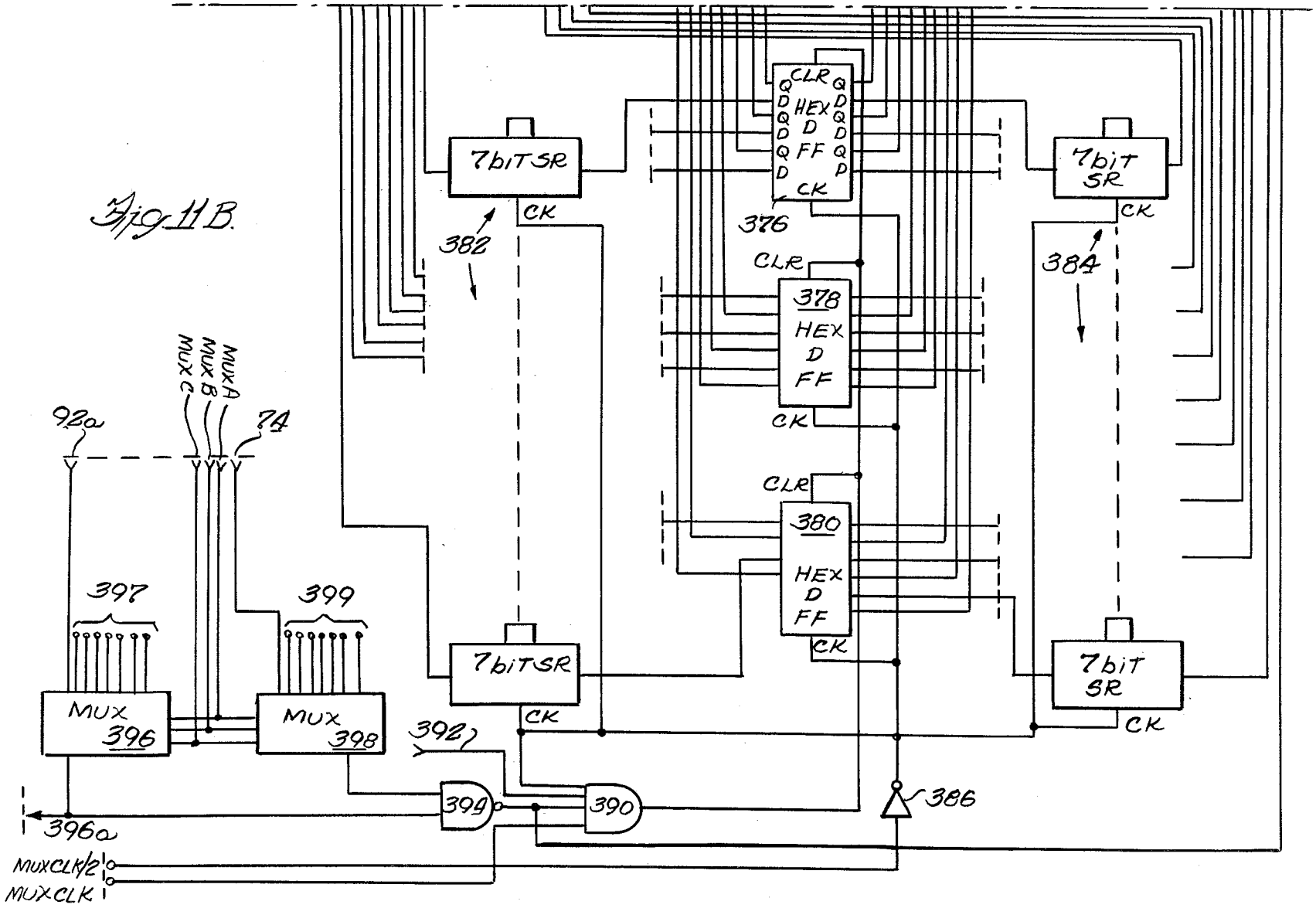

Referring now to FIGS. 11*a* and 11*b*, a circuit is illustrated which forms an alternate embodiment of the circuits illustrated and described in FIGS. 6, 7, and 8 hereinabove.

Figure 13:
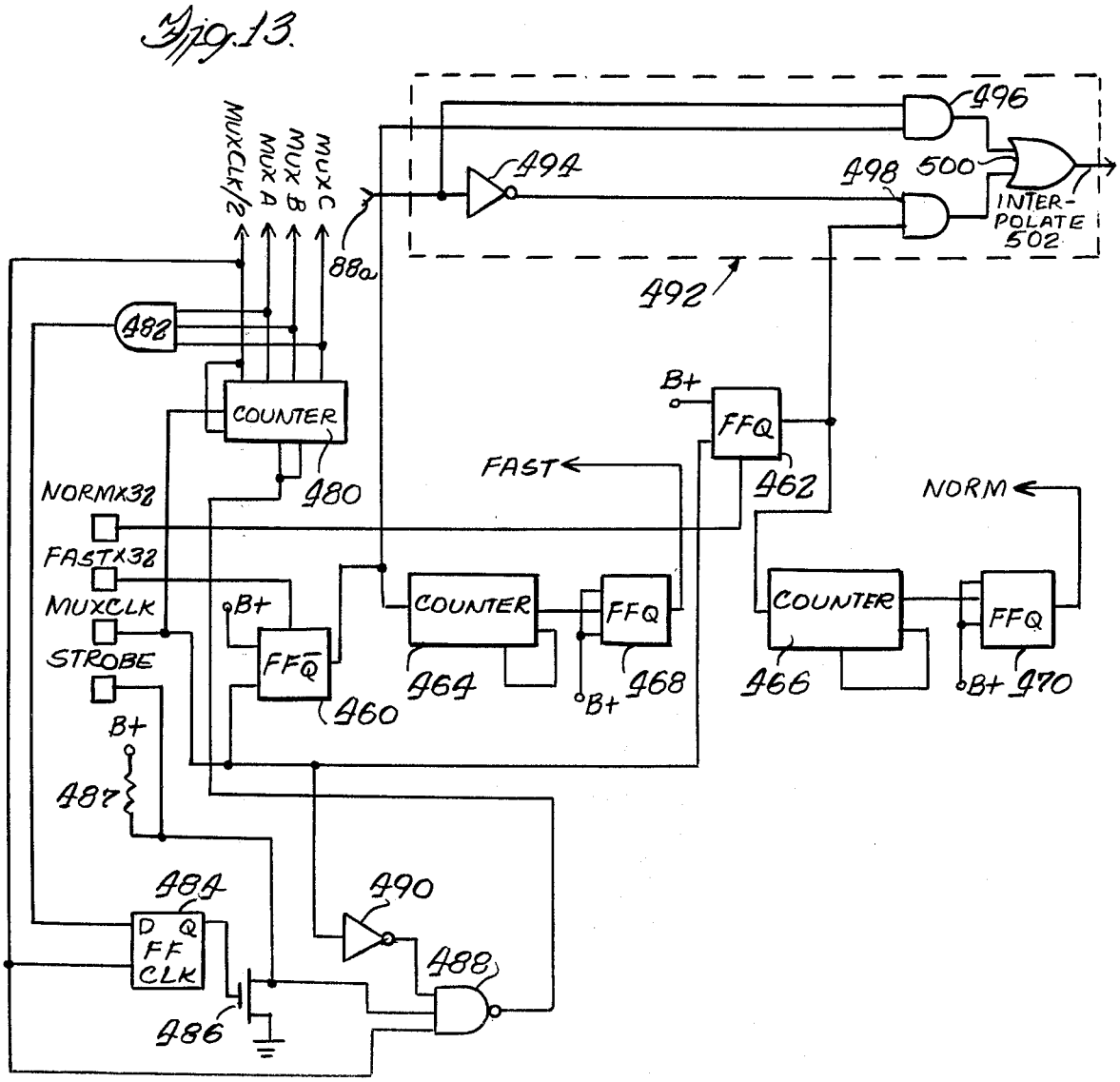

By way of introduction, while the circuits of FIGS. 6, 7 and 8 above derive a waveform generally in accordance with a formula $Y=B\pm MX$, the circuits of this alternate embodiment perform an operation $Y_{n+1}=Y_n+\Delta Y$. Similarly, while the first embodiment scales the envelope by multiplying the output $B\pm MX$ by a scaling factor S, the alternate embodiment to be hereinafter described adds the factor $\Delta Y$ to the previous value calculated a total of S times, thereby accomplishing the same result. The circuit to be hereinafter described with reference to FIGS. 11*a* and 11*b* and FIG. 12 accomplishes this latter arithmetic function. The circuit of FIG. 13 illustrates an alternative form of the derivation of the various timing or clock signals, and as such, represents an alternative embodiment of the circuit of FIG. 9.

Referring now to FIG. 11*a*, a read only memory (ROM) 350 stores the desired values of X MAX and $\Delta Y$ for each of the eight notes associated with the eight input circuits of the type shown in FIG. 2. In this regard, it will be remembered that the illustrated embodiment accommodates eight notes whose envelopes are to be formed thereby, for example, it may be associated with eight keys of a keyboard-type electronic musical instrument. The ROM 350, in the illustrated embodiment, is programmed in 128 words by 19 bits. The first seven bits of each word represent X MAX, while the remaining twelve bits represent $\Delta Y$. As in the first embodiment, described above, sixteen such words are programmed for each note, thereby providing sixteen segments to form the envelope waveshape for that note.

The ROM 350 is addressed by the address lines Ad0 through Ad3 from the multiplexers 186 through 192 of FIG. 5. Three additional memory select lines, designated generally 352 are provided to indicate which of the eight notes is currently being serially multiplexed in the system, and correspondingly, which of the eight sections of ROM is therefore required.

The twelve $\Delta Y$ outputs of the ROM 350 feed twelve inputs at one side of a seventeen-bit adder circuit, designated generally 354. In the illustrated embodiment, this seventeen-bit adder circuit comprises five, four-bit adders 356, 358, 360, 362 and 364. Only one bit of the adder 364 is utilized. The four address lines Ad0 through Ad3 feed respective inputs of a four-input OR gate 366 whose output feeds a control input of the first adder 356, as well as all four of the added inputs at one side of adder 362 and the single added input at one side of the adder 364.

The outputs of the seventeen-bit adder 354 comprise twelve whole bits and five fractional bits, for the purpose of interpolating certain portions of an envelope to avoid audible "jumps," as will be more fully discussed hereinbelow. The other set of added inputs of the adders 356 through 364 are also joined to the D inputs of a pair of HEX D flip-flop 368 and 369 whose Q outputs form the ultimate twelve-bit envelope signal, designated E0 through E11, of the invention. The twelve E output bits also feed twelve of the inputs of a thirteen-input NOR gate 370, whose output 372 feeds the circuit of FIG. 12, to be described hereinbelow.

The X MAX outputs of the ROM 350 feed one set of compared inputs of an eight bit comparator 374, whose opposite set of compared inputs receives the X signal bits X0 through X6, from the multiplexers 110 through 122, inclusive, of FIG. 3.

Referring now to FIG. 11B, it will be seen that the seventeen bits to be added at the opposite inputs of the seventeen-bit adder 354 are received from the Q output of three HEX D flip-flops 376, 378, and 380, which also feed the D inputs of the HEX D flip-fops 368, 369 of FIG. 11*a*. The summation outputs of the seventeen-bit adder 354 are fed to the respective data inputs of an array of seventeen seven-bit shift registers, generally designated 382 and 384. For clarity of illustration, only the first and last of eight such seven-bit shift registers 382 and the first and last of nine such seven-bit shift registers 384 have been illustrated, it being understood that the remaining shift registers 382 and 384 are identical, receiving successive outputs of the seventeen-bit adder 354.

The outputs of these seven-bit shift registers 382 and 384 feed respective D inputs of the HEX D flip-flops 376, 378 and 380. The clock inputs of the HEX D flip-flops 376, 378 and 380, as well as the clock inputs of the seven-bit shift registers 382 and 384 are all fed from the MUX CLK/2 line via an inverter 386. Accordingly, the seventeen bits of each of the eight envelopes being calculated are serially accommodated in the seventeen seven-bit shift registers 382 and 384 and are serially shifted out to the HEX D flip-flops 376, 378 and 380, and hence to the twelve D flip-flops 368 and E outputs.

Clear signals at suitable timing intervals are also fed to the HEX D flip-flops 376, 378 and 380 from the output of a four-input AND gate 390. This four-input AND gate 390 receives the MUX CLK/2 input from inverter 386 and a second input from a line 392 which is taken from FIG. 12 as will be described hereinbelow. A third input of AND gate 390 is received from a further two-input NAND gate 394 and the fourth input to AND gate 390 is the MUX CLOCK signal. The two inputs of NAND gate 394 are fed from a pair of multiplexers 396,398, each of which receives one input from each of the eight input circuits exemplified by the circuit of FIG. 2. Specifically, multiplexer 396 receives the outputs 92*a* of the AND gate 92 associated with each of the input circuits, while the multiplexer 398 receives the output lines 74 of each of these eight input circuits. The remaining inputs to multiplexers 396 and 398 are from the corresponding points on the remaining input circuits and are generally designated 397 and 399, respectively. The multiplex timing signals for the multiplexers 396 and 398 comprise the MUXA, MUXB and MUXC signals. The output of NAND gate 394 feeds the remaining input of NOR gate 370 of FIG. 11A.

Figure 12:
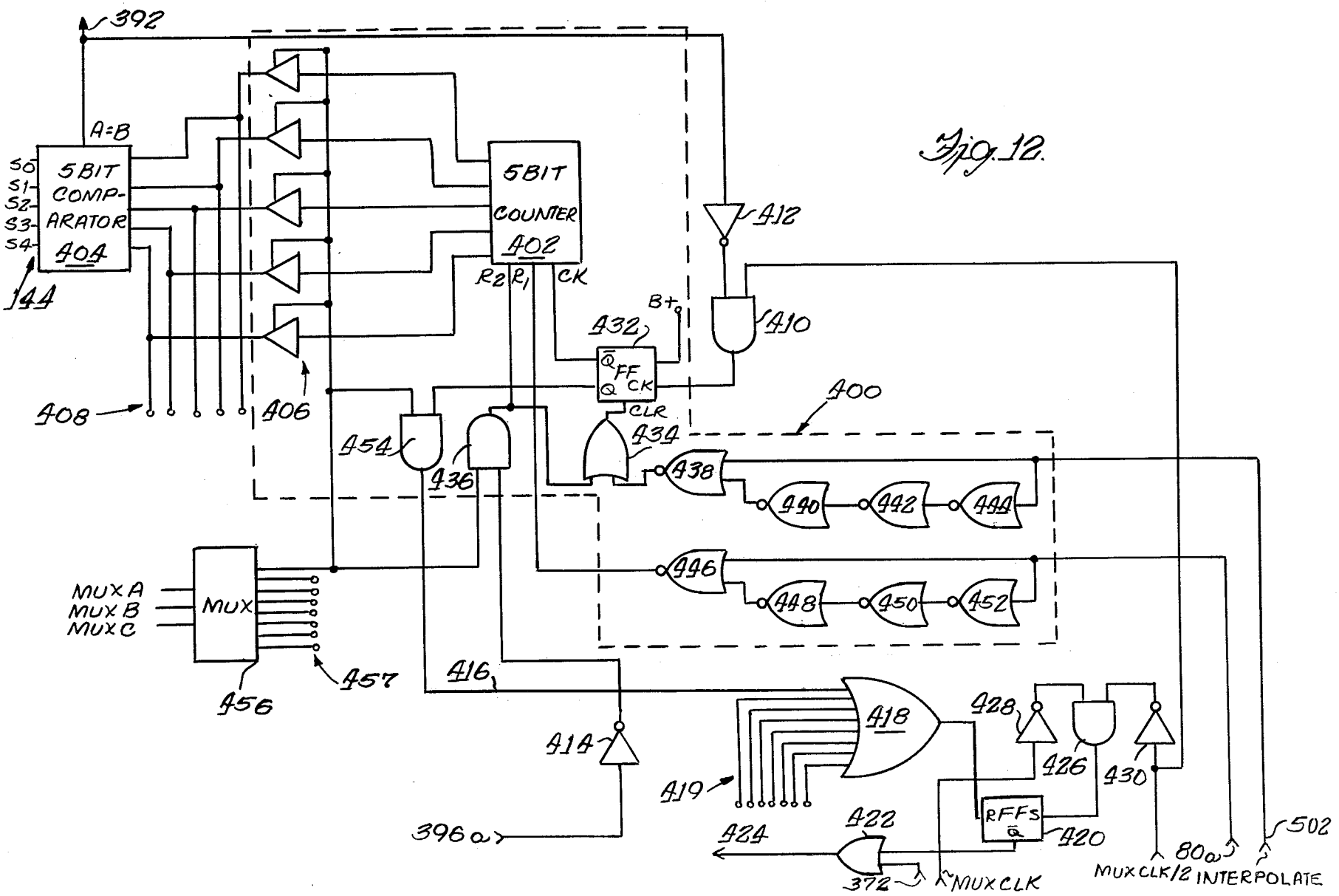

Reference is next invited to FIG. 12, wherein there is shown a typical one of eight circuits for interpolating the segments of the envelope for each of the eight notes accommodated by the circuits of the invention. Briefly, this circuit, designated generally 400, divides each of the segments into 32 sub-segments or sub-periods, for the purpose of adding each $\Delta Y$ to the previous Y value S times, as required by the corresponding scaling number S. As S may be a number as large as five binary bits, there are 32 possible S levels, and therefore, the 32 sub-periods provided for the required addition of $\Delta Y$ increments to the binary encoded signal.

To this end, a five-bit counter 402 feeds one set of compared inputs of a five bit comparator 404 by way of five controlled buffers 406. The similar five-bit inputs to comparator 404 from the other seven circuits 400 are indicated by terminals designated generally 408. The opposite compared input of the five bit comparator 404 is fed from the S outputs 144 of the scaling ROM 142 of FIG. 4. Accordingly, an A=B or compare signal will be given on the A=B output 392 (same as line 392 in FIG. 11B) of comparator 404 when the five bit count at counter 402 reaches the scaling number S from ROM 142. This comparison signal at the line 392 feeds AND gate 390 of FIG. 11B and also feeds one input of a two-input AND gate 410 via an inverter 412. The opposite input of AND gate 410 is taken from the MUX CLK/2 signal line. Remaining inputs to the interpolating circuit 400 comprise an "interpolate" line 502, an output 80*a* from the gate 80 of a corresponding one of eight input circuits 10 as illustrated in FIG. 2, and a line 396*a* from the output of multiplexer 396 of FIG. 11B. The line 396*a* is fed to the circuit 400 via a suitable inverter type buffer 414.

Outputs of the circuit 400 comprise a line 416 which feeds one input of an eight-input OR gate 418, the other seven inputs of which are fed from like output lines of the other seven circuits 400. The output of OR gate 418 feeds the reset input of a set-reset flip-flop 420 whose $\overline{Q}$ output feeds one input of a two-input OR gate 422 whose other input is fed from the line 372 from the OR gate 370 of FIG. 11A. The output of OR gate 422 feeds a line 424, which forms the enable input to the ROM 350 of FIG. 11A. The set input of flip-flop 420 is received from the output of a two-input AND gate 426 which receives the MUX CLOCK signal via an inverter 428 and the MUX CLOCK/2 signal via an inverter 430.

Referring now to the circuit 400, the five-bit counter 402 receives its clock input from the $\overline{Q}$ output of a flip-flop 432 which in return receives its clock input from the output of the AND gate 410. A clear input to the flip-flop 432 is received from the output of a two-input OR gate 434. The OR gate 434 receives one input from the output of a two-input AND gate 436 and the other input from the output of a delayed one-shot comprising NOR gates 438, 440, 442 and 444. Reset inputs of the five-bit counter 402 are fed respectively from the output of AND gate 436 and from the output of a second delayed one-shot comprising OR gates 446, 448, 450 and 452. The delayed one-shot comprising gates 438 through 444 receives as its input the interpolate signal line 502, while the delayed one-shot comprising OR gates 446 through 452 receives as its input the signal line 80*a*.

The output line 416 is fed from the output of a two-input AND gate 454, which receives one of its inputs from the Q output of the flip-flop 432. The remaining input of AND gates 436 and 454 are fed in common with the control inputs of buffers 406 from a first one of data output lines 457 of a demultiplexer or decoder 456, which has seven remaining similar data output lines 457 feeding the other seven circuits 400. Data select lines of the multiplexer 456 are fed from the MUXA, MUXB, and MUXC control lines. In the illustrated embodiment, the demultiplexer 456 is of the type 74LS138.

Referring now to FIG. 13, a circuit for deriving suitable timing or clock signals for the circuits of the invention forms an alternate embodiment to the circuit of FIG. 9. The basic signals fed to the circuit of FIG. 13 are a pair of clock signals at a rate 32 times the rate of the normal and fast clock signals described above with reference to FIG. 2. These signals are designated NORM X 32 FAST X 32 in FIG. 13. Further inputs are the MUX CLK clock signal and a STROBE control signal. The two clock signals are each fed to divide-by-32 circuits, prior to the feeding thereof to the normal (NORM) and fast (FAST) clock inputs of FIG. 2.

Briefly, these divide-by-32 networks each comprises a four bit counter circuit 464, 466, and an output flip-flop 468, 470. An input flip-flop 460, 462 is used to synchronize the FAST x 32 and NORM x 32 clocks to the MUX CLK clock. Similarly, the MUX CLK input feeds a four-bit counter 480, whose four output bits form, respectively the MUX CLK/2, MUXA, MUXB, and MUXC signals. The MUXA, MUXB, and MUXC signals are also fed to the respective inputs of a three-input AND gate 482, whose output feeds the D input of a D flip-flop 484. The Q output of the D flip-flop 484 feeds a gate electrode of an FET 486, whose drain electrode is fed from the STROBE input and provided with a suitable pull-up resistor 487 to a positive voltage (B+). The source electrode of FET 486 is tied to ground. The clock input of D flip-flop 484 is fed from the MUX CLK/2 line, which line also feeds one input of a three-input NAND gate 488, whose remaining inputs are fed from the STROBE clock input and from the MUX CLK input, respectively, the latter being fed via an inverter 490. The output of NAND gate 488 feeds reset inputs of the counter 480.

The interpolate signal on line 502 of each of the interpolating circuits 400 of FIG. 12, is provided by a corresponding circuit designated generally 492. One such circuit 492 is provided for each of the interpolating circuits 400 as illustrated in FIG. 12. The inputs of the circuits 492 comprise an output 88*a* of the AND gate 88 of its associated input circuit 10 of FIG. 2, the $\overline{Q}$ output of flip-flop 460 and the Q output of flip-flop 462. The line 88*a* feeds an inverter 494 and one input of a two-input AND gate 496. The output of inverter 494 feeds one input of a further two-input AND gate 498. The remaining inputs of the respective AND gates 496 and 498 are from the $\overline{Q}$ output of the flip-flop 460 and the $\overline{Q}$ output of the flip-flop 462, respectively. The outputs of AND gates 496 and 498 feed the respective inputs of a two-input OR gate 500, whose output forms the interpolate signal line 502 for the associated interpolating circuit 400.

Briefly, the foregoing circuits (FIGS. 11A and 11B, FIG. 12 and FIG. 13) operate to form an envelope by a technique which may generally be interpreted to as "delta modulation". This technique produces a digital representation of an envelope signal, calculated by the general formula $Y_x = Y_{x-1} + S\ (\Delta Y_x)$. Accordingly, it will be seen, that starting with a first value, i.e., $Y_O$ (the output signal E of FIG. 11A), a scaled signal for the next value $Y_1$ may be obtained merely by multiplying a given change in Y (i.e., $\Delta Y$) by the scaling number S. This operation is carried out in the circuits of the invention by incrementing the existing Y value by $\Delta Y$ a total of S times.

Referring briefly to the foregoing circuits (FIGS. 11A, 11B and 12), $\Delta Y$ for each note is a twelve-bit number obtained from the ROM 350. These bits are fed to respective input bits of four-bit adders 356, 358 and 360, to be added therein with twelve bits obtained from the HEX D flip-flops 376, 378 and 380 of FIG. 11B. The remaining outputs (of the HEX D flip-flop 380) are combined in four-bit adders 362 and 364 with the bit obtained from OR gate 366. The seventeen bit sum output from these adders 354 is fed to the seven-bit shift registers 382 and 384 of FIG. 11B, where the bits are shifted through in sequence of the serial multiplexing of the eight notes being simultaneously handled by the system of the invention. The seven-bit shift registers in turn feed this information to the HEX D flip-flops 376, 378 and 380, whereupon this sum is again incremented by (i.e., added to) $\Delta Y$ at the seventeen-bit adder circuit 354. Hence, it will be seen that successive increments $\Delta Y$ are added to the signal by this circuit. The circuit of FIG. 12, then, provides suitable control signals to the circuits of FIGS. 11A and 11B for accomplishing this incremental addition of $\Delta Y$ a total of S times, in accordance with the comparison of numbered five-bit counter 402 with the S number at comparator 404. The five-bit counter 402 counts from 0 at its reset to the scaling number S and then is not advanced for the remaining ones of 32 sub-periods (i.e., 32-S sub-periods) for each envelope period of the 16-segment envelope produced by the circuit. The five-bit comparator 404, upon reaching the scaling number S, causes the circuits of FIGS. 11A and 11B to "hold" the output E at the number which has been reached at that point, ceasing to add further $\Delta Y$ increments thereto.

While the foregoing circuits have been described with reference to the problem of providing a suitable waveform for the envelope of a musical tone, it will be recognized that the same circuits and principles incorporated therein may readily be used for the formation of a suitable tonal waveform as well. Essentially, all that need be done is increase the rate of operation of the circuits to a suitable rate to accomplish a repetitive output waveform of suitable shape to simulate the desired tonal qualities. Generally speaking, this can readily be accomplished by suitable increase of the rates of all the control timing signals or clocks, of FIGS. 9 and/or 13. In such an application, the interpolating feature of the circuit 400 of FIG. 12 might not be necessary, nor would the scaling feature provided by the two described embodiments be strictly necessary. In all other respects, however, the circuits described and their functions would be identical.

While preferred embodiments have been illustrated and described herein, the invention is not limited thereto. On the contrary, various alternatives, modifications and changes may occur to those skilled in the art, and the present invention is intended to include such alternatives, modifications and changes insofar as they fall within the spirit and scope of the appended claims.

The invention is claimed as follows:

1. In an electronic musical instrument of the type wherein an audible tone is generated electronically in response to an actuation of tone initiating means of the instrument by a player, an envelope generation system for producing a plurality of envelope signals which define a preselected envelope waveform, said envelope generation system comprising: input circuit means responsive to player actuation of said tone-initiating means for producing envelope control signals and for producing a series of envelope count signals, clock means for generating a series of timing signals, envelope control circuit means responsive to said envelope control signals and to said timing signals for generating a series of predetermined digital increment defining signals, arithmetic circuit means for performing predetermined arithmetic functions utilizing said increment defining signals and said envelope count signals to produce therefrom a series of digital envelope signals collectively defining said envelope waveform wherein said arithmetic circuit includes means for producing said series of digital envelope signals $Y_x$ in accordance with the equation $Y_x = Y_x - 1 \pm \Delta Y$ where x represents ones of said series of envelope count signals, $Y_x$ and $Y_x - 1$ represent ones of said digital envelope signals produced in response to envelope count signals x and x−1, and $\Delta Y$ represents one of said digital increment defining signals, said envelope generation system further including scaling means for producing a digital scaling signal corresponding to the intensity of player actuation of said tone initiating means and wherein said arithmetic circuit means further includes means for producing said series of digital envelope signals $Y_x$ in accordance with the equation $Y_x = Y_x - 1 \pm S \cdot \Delta Y_x$, where S represents said digital scaling signal.

2. In an electronic musical instrument of the type wherein an audible tone is generated electronically in response to an actuation of tone initiating means of the instrument by a player, said tone initiating means including a key and a keyswitch having a movable contact movable from a first fixed contact to a second switch contact, an envelope generation system for producing a plurality of envelope signals which define a preselected envelope waveform said envelope generation system comprising: input circuit means responsive to player actuation of said tone-initiating means for producing envelope control signals, scaling control signals related to the transit time of said movable contact from said first to said second fixed contact and representing the intensity with which a player actuates said tone initiating means, and a series of envelope count signals, clock means for generating a series of timing signals, envelope control circuit means responsive to said envelope control signals and to said timing signals for generating respective series of predetermined digital envelope segment slope and intercept defining signals, scaling control circuit means responsive to said scaling signals for generating respective series of digital scaling control signals, digital arithmetic circuit means for performing predetermined arithmetic functions utilizing said digital envelope segment slope and intercept defining signals, said digital scaling control signals, and said envelope count signals to produce therefrom a series of digital envelope signals collectively defining said envelope waveform and amplitude and wherein said arithmetic circuit means includes means for producing said series of digital envelope signals Y in accordance with the equation $Y = S(B \pm MX)$ where M represents one of said series of digital slope defining signals, S represents one of said scaling control signals, X represents one of the series of envelope count signals and B represents one of said series of digital intercept defining signals.

3. An envelope generation system according to claim 2 wherein said envelope control circuit includes memory means for storing a plurality of binary encoded signals corresponding to said digital envelope segment slope and intercept defining signals and means for addressing said memory means in a predetermined fashion in response to said envelope control signals and said timing signals.

4. An envelope generation system according to claim 3 wherein said memory means comprises at least one ROM.

5. An envelope generation system according to claim 3 and wherein said envelope control circuit means further includes maximum count means for generating digital signals corresponding to a predetermined maximum envelope count and means for terminating the production of said series of digital envelope signals when the envelope count signals reach said maximum count, thereby defining the time duration of said envelope waveform.

6. An envelope generation system according to claim 5 wherein said maximum count means comprises further memory means for storing a plurality of binary encoded signals each corresponding to one said maximum envelope count, and wherein said envelope control circuit means includes means for addressing both of said memory means in response to said envelope control signals and said timing signals.

7. An envelope generation system according to claim 6 wherein said first-mentioned memory means and said further memory means comprise at least one ROM.

8. An envelope generation system according to claim 2 wherein said arithmetic circuit means includes multiplier circuit means.

9. An envelope generation system according to claim 2 wherein said arithmetic circuit means includes adder circuit means.

* * * * *

UNITED STATES PATENT AND TRADEMARK OFFICE

CERTIFICATE OF CORRECTION

PATENT NO. : 4,333,377

DATED : June 8, 1982

INVENTOR(S) : Thomas A. Niezgoda and Carl P. Oppenheimer

It is certified that error appears in the above-identified patent and that said Letters Patent are hereby corrected as shown below:

Change the name of the assignee to:
THE WURLITZER COMPANY, DeKalb, Illinois

Change the name of the attorneys to:
TREXLER, BUSHNELL & WOLTERS, LTD.

Col. 2, line 58, change "of" , first occurrence, to -- or --.

Col. 6, line 53, change "or" , second occurrence, to -- of --.

Col. 7, line 28, change "94" to -- 92 --.

Signed and Sealed this

*Seventeenth* Day of *August 1982*

[SEAL]

*Attest:*

GERALD J. MOSSINGHOFF

*Attesting Officer*

*Commissioner of Patents and Trademarks*